United States Patent [19]

Meyering et al.

[11] 3,990,483

[45] Nov. 9, 1976

[54] WEAVING SHUTTLE

[75] Inventors: Otto Meyering, Oeding; Wilhelm Schmidt, Borken I, both of Germany

[73] Assignee: Gebr. Schmeing, Borken-Weseke, Germany

[22] Filed: Jan. 22, 1976

[21] Appl. No.: 651,608

[30] Foreign Application Priority Data

Feb. 26, 1975 Germany ..... 2508179

[52] U.S. Cl. ..... 139/196.1; 428/249

[51] Int. Cl.[2] ..... D03J 5/02

[58] Field of Search ..... 139/196.1–196.4; 428/248, 249, 316

[56] References Cited

UNITED STATES PATENTS

| | | | |
|---|---|---|---|
| 1,861,593 | 6/1932 | Christoph | 139/196.1 |
| 3,089,522 | 5/1963 | Phelps | 139/196.1 |
| 3,565,124 | 2/1971 | Dupre | 139/196.1 |
| 3,660,219 | 5/1972 | Pugh, Jr. et al. | 139/196.1 |

FOREIGN PATENTS OR APPLICATIONS

| | | | |
|---|---|---|---|
| 1,042,025 | 6/1953 | France | 139/196.1 |
| 365,976 | 12/1938 | Italy | 139/196.1 |
| 218,874 | 7/1924 | United Kingdom | 428/249 |
| 325,194 | 2/1972 | U.S.S.R. | 428/249 |

*Primary Examiner*—James Kee Chi

*Attorney, Agent, or Firm*—Merchant, Gould, Smith, Edell, Welter & Schmidt

[57] ABSTRACT

A weaving shuttle having a metal or wood winding core is shown. The core is wrapped with alternating hardened layers of fabric soaked with plastic, and plywood. Preferably, the direction of the warp threads in the fabric layers alternate between running parallel to the longitudinal axis of the weaving shuttle and perpendicular thereto, except for the outermost layers where only fabric course sheets are present in which the warp threads run parallel to the longitudinal axis of the shuttle.

5 Claims, 2 Drawing Figures

WEAVING SHUTTLE

BACKGROUND OF THE INVENTION

1. Field of the Invention:

The invention relates to a weaving shuttle wherein a core is wrapped with fabric courses that have been soaked with plastic in order to form the body of the shuttle.

2. Description of the Prior Art:

Already known from German Pat. No. 567,745 is a shuttle that consists of a wooden core, and of a covering of fabric courses soaked with synthetic resin plastic wound on said core. With this arrangement, the shuttle that in itself consists of wood will be protected against mechanical and chemical attacks, but in particular also against splintering.

The striving by the technical world to increase the service life and duration, respectively, of a weaving shuttle appeared to have been solved with the arrival of synthetic resin plastics, and particularly with synthetic resin plastic soaked fabric courses since such types of weaving shuttles that are equipped with fabric courses do last longer.

The application of such types of weaving shuttles in practice was, however, not successful since, relative to their improved duration, they displayed too great a specific weight so that the high speed cadence of today's weaving looms could not be maintained and the forces required for driving and braking the shuttle were too high, whereby unallowable heating and wearing phenomena appeared.

Hence, the task set forth for the invention is to obtain a weaving shuttle displaying a high resistance to abrasion and thereby a long operational life as well, whereby simultaneously, however, the specific weight is not greater than present commercial weaving shuttles consisting purely of wood.

SUMMARY OF THE INVENTION

This task set forth for the invention is solved in that layers of plywood are arranged between the individual layers of fabric courses. While so-called, especially suited industrial fabric for application for weaving shuttles displays a specific weight of 1.3 to 1.4, it is possible to construct plywood layers whose specific weight is 0.65 to 0.75. By combination of these two sheets the total weight of the weaving shuttle is reduced, and along with this the most advantage is taken of the high resistance to abrasion of the layers of fabric courses.

According to a further characteristic of the invention it is foreseen that the direction of the warp threads, relative to the longitudinal axis of the weaving shuttle, are displaced, in turn, 90° from fabric course layer to fabric course layer, so that the strength introduced into the fabric by the warp threads is present in all directions of the weaving shuttle and the breaking strength of two layers of fabric courses is greatly improved.

Preferably, we proceed such that the outer skin of the weaving shuttle is formed by several fabric courses lying immediately one over the other, with their warp threads running along the longitudinal axis of the weaving shuttle.

BRIEF DESCRIPTION OF THE DRAWINGS

One example of embodiment for the invention will be explained, with the aid of the drawing, in the following. The drawing shows in FIG. 1 to an enlarged scale and in a spread apart method of representation, the different sheets building up the body of the shuttle; and in FIG. 2 a cut through a schematic structuring of the new weaving shuttle.

DESCRIPTION OF THE PREFERRED EMBODIMENT

Figure 1:
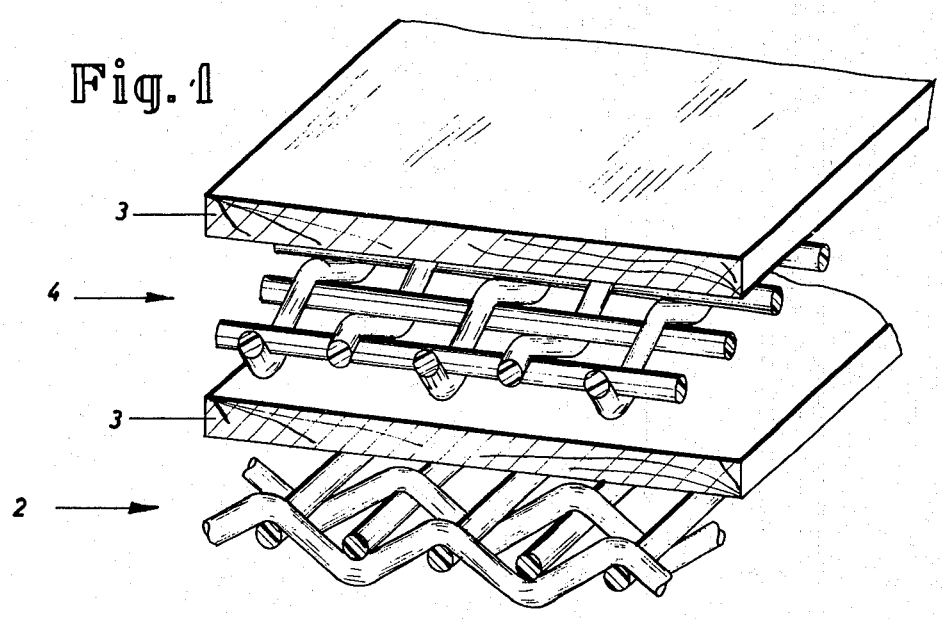
Figure 2:
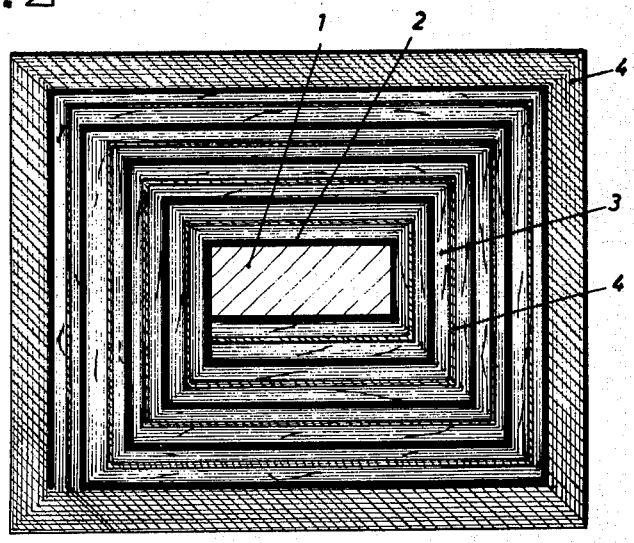

In FIG. 2, 1 designates a metal or wood winding core over which is first arranged a fabric course sheet and/or layer 2 whose warp threads are aligned perpendicularly to the longitudinal axis of the weaving shuttle. This fabric course sheet is likewise designated by 2 in FIG. 1. After the core is sleeved with such a fabric course sheet 2, there next follows an overlayment of plywood 3 and over this latter a fabric course sheet and/or layer 4 whose warp threads run parallel to the longitudinal axis of the weaving shuttle. After overlayment of a new layer of plywood then another overlayment of a fabric course 2, and so forth.

It is only in the outer region of the weaving shuttle that we continue neither with the plywood layer 3 nor the fabric course sheet 2, rather, only fabric course sheets 4 are present in this outer region, i.e., therefore fabric courses in which the warp threads run along the longitudinal axis or parallel to the longitudinal axis of the weaving shuttle.

It is self understood that the invention is not limited to this special example of embodiment. In the same manner it is possible to insert exclusively fabric course sheets 4, the determining factor being the combination between plastic soaked fabric course sheets and plywood.

What is claimed is:

1. A weaving shuttle comprising:
   an elongated core;
   continuous fabric courses soaked with plastic and wrapped about the core to form a plurality of fabric layers; and
   a continuous layer of wood disposed between the continuous fabric courses and wrapped about the core whereby wood layers are arranged between the layers of fabric soaked with plastic.

2. A weaving shuttle in accordance with claim 1 wherein the wood is plywood.

3. A weaving shuttle in accordance with claim 1 wherein the direction of the warp threads in the fabric courses relative to the longitudinal axis of the weaving shuttle are displaced 90° from continuous fabric course to continuous fabric course.

4. A weaving shuttle in accordance with claim 3 wherein two continuous fabric courses are wrapped about the core.

5. A weaving shuttle in accordance with claim 3 wherein the outer skin of the weaving shuttle is formed by several fabric courses lying immediately one over the other, with their warp threads running along the longitudinal axis of the weaving shuttle.

* * * * *